US009289354B2

(12) United States Patent
Ryan

(10) Patent No.: US 9,289,354 B2
(45) Date of Patent: Mar. 22, 2016

(54) PILL ORGANIZER

(71) Applicant: Francis Ryan, East Greenbush, NY (US)

(72) Inventor: Francis Ryan, East Greenbush, NY (US)

( * ) Notice: Subject to any disclaimer, the term of this patent is extended or adjusted under 35 U.S.C. 154(b) by 0 days.

(21) Appl. No.: 14/557,862

(22) Filed: Dec. 2, 2014

(65) Prior Publication Data

US 2015/0366753 A1 Dec. 24, 2015

Related U.S. Application Data

(60) Provisional application No. 62/013,588, filed on Jun. 18, 2014.

(51) Int. Cl.

| | |
|---|---|
| ***B65D 83/04*** | (2006.01) |
| ***A61J 1/03*** | (2006.01) |
| ***B65D 25/06*** | (2006.01) |

(52) U.S. Cl.

CPC . *A61J 1/03* (2013.01); *B65D 25/06* (2013.01); *A61J 2205/50* (2013.01)

(58) Field of Classification Search

USPC ..... 206/534, 538

See application file for complete search history.

(56) References Cited

U.S. PATENT DOCUMENTS

| | | | | |
|---|---|---|---|---|
| 5,240,113 | A * | 8/1993 | Gibilisco | 206/534 |
| 5,267,650 | A * | 12/1993 | Gilbilisco | 206/534 |
| D349,850 | S | 8/1994 | Leman | |
| 5,954,225 | A * | 9/1999 | Powe | 221/2 |
| 6,464,506 | B1 * | 10/2002 | Welles | 434/238 |
| 6,662,081 | B1 * | 12/2003 | Jacober et al. | 700/242 |
| 6,779,663 | B1 | 8/2004 | Pocsi | |
| D576,404 | S | 9/2008 | Cooper | |
| 7,494,012 | B1 * | 2/2009 | Priebe et al. | 206/538 |
| 8,253,561 | B2 | 8/2012 | Bowers | |
| D679,086 | S | 4/2013 | Liguori | |
| 2001/0045373 | A1 * | 11/2001 | Peterson | 206/538 |
| 2004/0050747 | A1 * | 3/2004 | Iso | 206/534 |
| 2004/0251165 | A1 * | 12/2004 | Girzaitis | 206/534 |
| 2005/0045519 | A1 * | 3/2005 | Hirsch | 206/534 |
| 2006/0021900 | A1 * | 2/2006 | Feodoroff | 206/534 |
| 2008/0277307 | A1 * | 11/2008 | Mazur | 206/534 |
| 2013/0195326 | A1 * | 8/2013 | Bear et al. | 382/128 |
| 2014/0001078 | A1 * | 1/2014 | Andrews et al. | 206/534 |
| 2014/0166529 | A1 * | 6/2014 | Fung et al. | 206/534 |
| 2014/0251861 | A1 * | 9/2014 | Priebe et al. | 206/534 |

* cited by examiner

*Primary Examiner* — Jacob K Ackun

(74) *Attorney, Agent, or Firm* — Daniel Boudwin; Global Intellectual Property Agency, LLC

(57) ABSTRACT

A pill organizer having a plurality of storage compartments in which pills can be stored. The device includes a housing having recessed areas in which several elongated containers can be removably positioned. The elongated containers are separated into multiple compartments each having a hinged lid. The compartments are arranged in a grid so as to represent the days of the month. The compartments further include numbered indicia on the lid thereof. The housing further includes a digital display thereon for showing the day of the month, and optionally the full date and time. A notepad is provided on the housing for allowing the user to write notes and reminders regarding his or her medication. Thus, the present invention provides a device that allows a user to more easily store and organize his or her medications.

10 Claims, 2 Drawing Sheets

PILL ORGANIZER

CROSS REFERENCE TO RELATED APPLICATION

This application claims the benefit of U.S. Provisional Application No. 62/013,588 filed on Jun. 18, 2014. The above identified patent application is herein incorporated by reference in its entirety to provide continuity of disclosure.

BACKGROUND OF THE INVENTION

Field of the Invention

The present invention relates to a pill organizer. More specifically, the present invention provides an improved pill organizer having a plurality of containers having multiple compartments representing each day of the month. The containers are arranged in a grid to represent a calendar for helping a user to remember which pills to take on a particular day.

Many individuals, particularly the elderly and chronically ill, are required to take one or more medications each day. The medications may be taken with various frequency, and some medications may be taken multiple times per day while others are taken only once per day. Further, some medications instruct the person to take two tablets at a time, while others are taken one at a time. As a result, many people have difficulty remembering which pills to take on a particular day and how many of those pills to take. Further, people may forget whether or not they have taken their medication on a particular day, causing the person to miss a dosage or double their recommended dosage.

If a person misses their medication or otherwise takes the incorrect dose of the medication, the efficacy of the medication may be mitigated considerably. As a result, the user may not reap the benefits of the medication, and a person's condition may worsen if the person is not properly medicated. Further, the user may experience negative side effects from taking too much of a medication and may even experience withdrawal symptoms. Thus, an improved pill organizer for helping a user to keep track of his or her medications is desired.

The present invention provides a pill organizer comprising a housing in which several elongated containers can be removably positioned. The housing includes a plurality of recessed areas that are sized so as to receive the elongated containers therein. The elongated containers are divided into multiple compartments in which pills can be stored. Each compartment includes a hinged lid with a numbered indicia thereon corresponding to a day of the month. The compartments are arranged in a grid so as to resemble a calendar. Preferably, there are seven containers, wherein each container is divided into five compartments. The housing further includes a digital display thereon adapted to display the day of the month, and optionally the date and time. In this way, a user can easily use the display to determine the day of the month, and can take the pills that are stored in the compartment corresponding to that day of the month. The present invention may further include a notepad on the housing adjacent to the digital display, so that a user may write notes related to his or her medications thereon.

DESCRIPTION OF THE PRIOR ART

Devices have been disclosed in the prior art that relate to pill organizers. These include devices that have been patented and published in patent application publications. These devices generally relate to pill organizers resembling a calendar having a pill compartment for each day of the week or month. The following is a list of devices deemed most relevant to the present disclosure, which are herein described for the purposes of highlighting and differentiating the unique aspects of the present invention, and further highlighting the drawbacks existing in the prior art.

One such device, U.S. Pat. No. 6,779,663 to Pocsi discloses a system and method for loading a pillbox. The system includes a pillbox loader and a pillbox. The loader has a plurality of containers and is positioned on top of the pillbox. A pillbox loader form is positioned within the loader's bottom plate and is slidably inserted between the pill loader and pillbox so that the loading instructions are visible in the loader containers. Once filled, the loader form can be removed, causing the pills to drop into the pillbox. Thus, Pocsi discloses a pillbox having multiple compartments, but fails to disclose a pillbox having a digital display thereon that indicates the day and time for aiding the user in taking the correct medication.

U.S. Pat. No. 8,253,561 to Bowers discloses a medication management device. The device includes a pill organizer having rectangular units for containing pills. Rows of seven units corresponding to the days of the week attach and detach from one another. The device includes electronic components for allowing the user to input and store information on the pill organizer. Thus, Bowers discloses a pill organizer having multiple compartments representing each day of the week. However, Bowers fails to disclose a pill organizer of the same construction as the present invention. Bowers does not disclose a pill organizer having a plurality of containers removably positioned within a housing having recessed areas adapted to receive the containers therein.

U.S. Design Pat. No. D576404 to Cooper discloses the ornamental design for a pill organizer. The pill organizer comprises a base having a plurality of compartments arranged in multiple rows, wherein each compartment represents a day of the month. The pill organizer further includes a digital clock and calendar for displaying the day and time. Similarly, U.S. Design Pat. No. D679086 to Liguori discloses the ornamental design for a pill box. The device includes a flat base having a plurality of compartments arranged in multiple rows labeled with a number and the day of the week. The base includes a display thereon for indicating the date or time, and one or more controls for setting the date and time. Additionally, U.S. Design Pat. No. D349850 to Leman discloses the ornamental design for a pill organizer. The pill organizer includes a flat base having a plurality of pill storage compartments arranged in a grid. The pill organizer includes four rows of seven containers.

These prior art devices have several known drawbacks. The devices in the prior art provide pill organizers having a plurality of pill storage compartments arranged by day or time of day. These devices do not include elongated containers divided into multiple compartments each having its own hinged lid. Pill organizing devices having a number of separated, individual compartments may be harder for users to grasp and fill, as the user must individually remove and fill each of the pill compartments one by one. In contrast, the present invention preferably provides a pill organizer having seven containers each with five compartments. This allows a user to more easily grasp a container and remove pills from or insert pills into a single compartment. Further, many devices do not include a digital display thereon for indicating the day of the month, and users may not know the day of the month off-hand or may be incorrect about the day of the month, causing the person to take the wrong medication.

In light of the devices disclosed in the prior art, it is submitted that the present invention substantially diverges in design elements from the prior art and consequently it is clear that there is a need in the art for an improvement to existing pill organizing devices. In this regard the instant invention substantially fulfills these needs.

SUMMARY OF THE INVENTION

In view of the foregoing disadvantages inherent in the known types of pill organizing devices now present in the prior art, the present invention provides a new pill organizer wherein the same can be utilized for providing convenience for the user when storing and organizing medications.

It is therefore an object of the present invention to provide a new and improved pill organizer device that has all of the advantages of the prior art and none of the disadvantages.

It is another object of the present invention to provide a pill organizer device comprising a housing having a number of elongated containers having multiple compartments therein corresponding to the days of the month.

Another object of the present invention is to provide a pill organizer device wherein each pill compartment is labeled with a day of the month.

Yet another object of the present invention is to provide a pill organizer device comprising a digital display thereon for displaying the day of the month and optionally the date and time.

A further object of the present invention is to provide a pill organizer device having a notepad thereon for providing space for a user to write reminders and notes about his or her medication.

Another object of the present invention is to provide a pill organizer device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
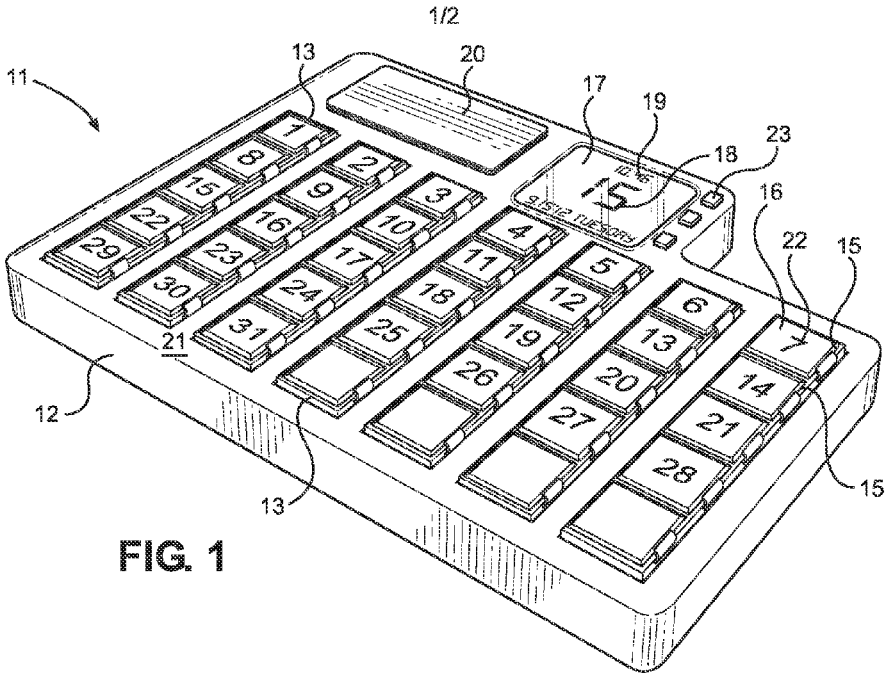
FIG. 1 shows a perspective view of the pill organizer device of the present invention.

Reference is made herein to the attached drawings. Like reference numerals are used throughout the drawings to depict like or similar elements of the pill organizer device. For the purposes of presenting a brief and clear description of the present invention, the preferred embodiment will be discussed as used for storing and organizing a user's medication so as to help a user remember to take an appropriate dosage of his or her medication each day. The figures are intended for representative purposes only and should not be considered to be limiting in any respect.

Figure 2:
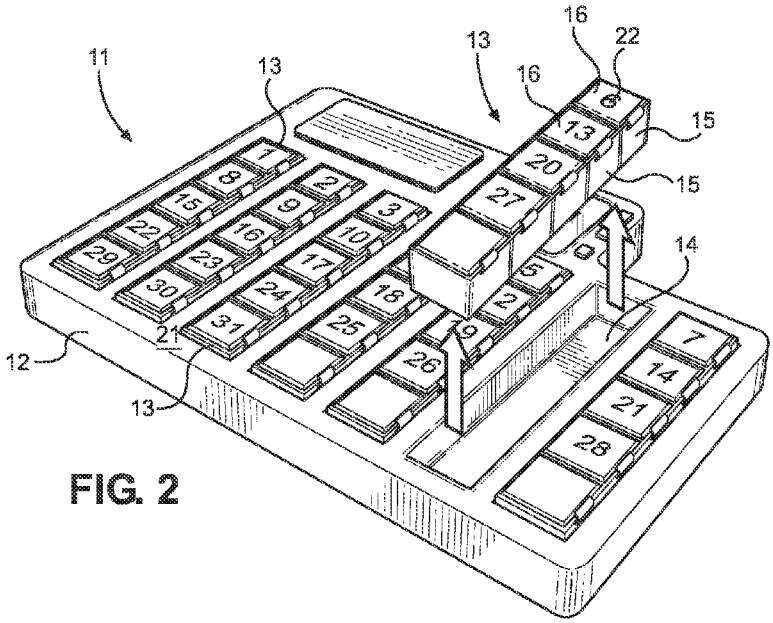
FIG. 2 shows a perspective view of the pill organizer device of the present invention with a container removed therefrom.

Referring now to FIGS. 1 and 2, there are shown perspective views of the pill organizer of the present invention. The pill organizer 11 comprises a housing 12 for storing a plurality of elongated containers 13 therein. Preferably, the housing 12 includes a number of recessed areas 14 adapted to receive the elongated containers 13 therein. The containers 13 can be removably inserted into the recessed areas 14 of the housing 12. Each container 13 includes a plurality of compartments 15 each having a hinged lid 16, wherein each compartment 15 corresponds to a day of the month.

The recessed areas 14 are of equal shape and dimension. Additionally, the recessed areas 14 are aligned and are parallel to one another. The recessed areas 14 are dimensioned so as to removably receive the elongated containers 13 therein. When inserted therein, the elongated containers 13 extend slightly above the upper surface 21 of the housing 12 so that the user can easily grasp the containers 13 in order to remove the containers 13 from the recessed areas 14.

Each container 13 includes a base, upstanding sidewalls, and an open upper end. The containers 13 further include a plurality of interior dividing walls that define a plurality of compartments 15 therein. The compartments 15 are of equal shape and dimension. In a preferred embodiment, each elongated container 13 is substantially rectangular and each compartment 15 is square in shape. Preferably, the pill organizer 11 comprises seven containers 13, wherein each container 13 corresponds to a day of the month. Further, each container 13 is preferably divided into five compartments 15. The containers 13 and compartments 15 therein are arranged in a grid layout, so as to resemble a calendar. The compartments 15 each include an indicia 22 thereon corresponding to the day of the month, and the compartments 15 are numbered sequentially.

In operation, the user can remove a container 13 from the housing 12, and fill each compartment 15 within that container 13 with pills for a particular day.

This allows a user to easily fill multiple compartments 15. Further, the elongated container 13 is more easily grasped than if each compartment 15 was individual and separate from the other compartments 15.

The housing 12 further includes a digital display 17 for showing the day of the month 18 and the time of day 19. The digital display 17 preferably includes a digital clock for determining the date and time. It is contemplated that the housing 12 includes the necessary circuitry to operate the digital display 17, wherein the electrical circuitry may be enclosed within the interior of the housing 12. Further, a power source, such as one or more batteries can be used to power the digital display 17, and can be positioned within the housing 12. The date and time on the digital display 17 can be set using control buttons 23, switches, or similar means that are accessible from the exterior of the housing 12. The housing 12 may optionally include a notepad 20 on which a user can write notes, reminders, and other information as desired.

Figure 3:
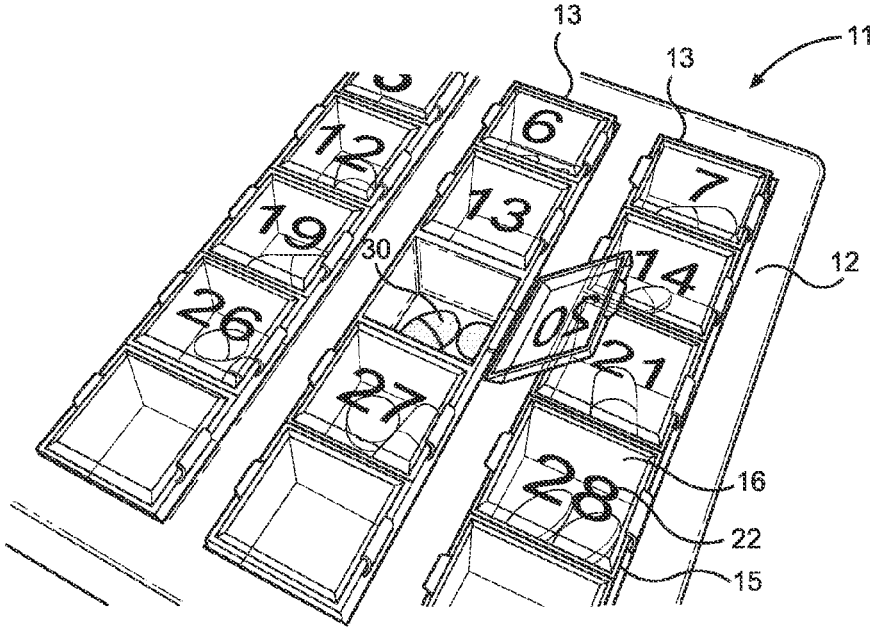
FIG. 3 shows a close-up view of a container of the present invention.

Referring now to FIG. 3, there is shown a close-up view of a container 13 of the present invention 11. The compartments 15 are adapted to receive one or more pills 30, capsules, tablets, or other similar types of medication therein. Each compartment 15 includes a hinged lid 16 for sealing the compartment 15. The hinged lid 16 is movable between a closed position in which the interior volume of the compartment 15 is sealed, and an opened position for accessing the interior volume thereof. The hinged lid 16 comprises a tab thereon, so that the user can grab the tab and easily open the lid 16. Additionally, the hinged lid 16 may be substantially transparent so that the user can see the pills on the interior of the compartment 15.

Each compartment 15 includes an indicia 22 on the lid 16 thereof that corresponds to a day of the month. The compartments 15 in the various containers 13 are numbered from left to right, and from top to bottom. Thus, the top left compartment 15 on the leftmost container 13 is numbered one, the top compartment on the container that is adjacent to the leftmost container is labeled two, and so on. The compartments are numbered one through thirty-one, leaving one or more compartments unnumbered. These compartments can be permanently sealed so that no pills can be stored therein, or can be used for additional storage.

Figure 4:
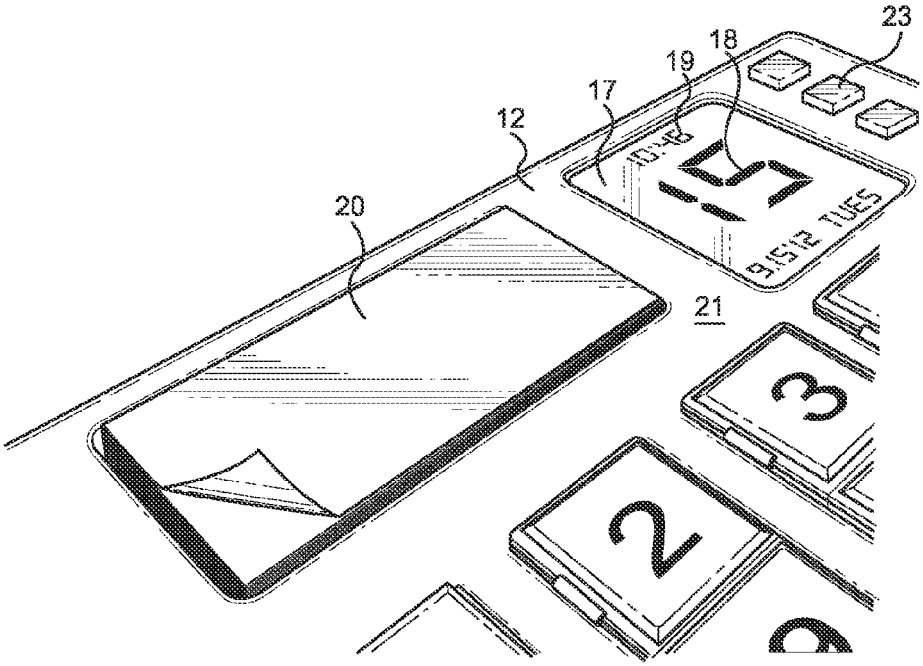
FIG. 4 shows a close-up view of a digital display and notepad on the pill organizer device.

Referring now to FIG. 4, there is shown a close-up view of a digital display and notepad on the pill organizer device. The digital display 17 may include a segment display, LCD display, or other type of display. The display 17 includes a digital clock, and is powered by a power source stored within the housing 12. The power source is preferably one or more batteries. The digital display 17 shows the day of the month 18. In this way, the user can read the display 17 to determine the day of the month, and can then take the pills stored in the compartment corresponding to that day. The display 17 may optionally display the time of day 19, the day of the week, and the full date. The time of day may be useful wherein the person is supposed to take pills at various times throughout the day.

In some embodiments of the present invention, the housing 12 includes a notepad 20 on the upper surface 21 thereof. The notepad 20 provides a plurality of sheets of paper on which the user can write. The sheets are secured together by an adhesive on a portion thereof or by a binding along one side thereof. The user can write notes or reminders thereon, such as whether to take medication with a meal, whether a medication needs to be refilled, or what time of day to take the medication. Alternatively, if a user must take different pills at different times of day, the user may utilize multiple pill organizing devices of the present invention.

In operation, the user may fill each compartment with pills to be taken on that day. Each day, the user can read the day of the month on the digital display to allow the user to easily determine the day of the month. The user can then open the lid on the compartment corresponding to that day of the month, and can take the pills held therein. The compartments may be transparent to allow the user to determine if there are pills within the container. Further, if the user has forgotten whether or not he or she has taken his or her medication for the day, the user can simply look at the compartment for that day and see if there is still medication therein.

Thus, the present invention allows a user to easily store and organize various medications to be taken periodically throughout the month.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pill organizer, comprising:

a housing having an upper surface comprising a plurality of removable containers positioned therein;

a plurality of recessed areas disposed on the housing;

wherein each of said plurality of recessed areas is adapted to receive one of said plurality of removable containers therein;

each of said removable containers having a plurality of compartments therein adapted to receive one or more pills;

said plurality of removable compartments arranged in a grid layout;

each of said plurality of compartments including a hinged lid;

wherein said plurality of compartments include numerical indicia thereon corresponding to the numerical date of a calendar month, said plurality of compartments being numbered sequentially in said grid layout resembling the layout of a calendar month; and a digital display disposed on said upper surface of said housing and adapted to display the numerical date of a calendar month corresponding to the indicia on one of said plurality of compartments for instructing a user to ingest the one or more pills inserted therein.

2. The pill organizer of claim 1, wherein said digital display is further adapted to display the time of day.

3. The pill organizer of claim 1, further comprising a notepad thereon.

4. The pill organizer of claim 1, wherein said plurality of containers includes seven containers.

5. The pill organizer of claim 4, wherein each of said plurality of containers includes five compartments therein.

6. The pill organizer of claim 1, wherein each of said plurality of containers corresponds to a day of the week.

7. The pill organizer of claim 1, wherein the digital display comprises a digital clock for determining the date and time.

8. The pill organizer of claim 1, wherein the sequential numbering of the plurality of compartments ends at thirty-one.

9. The pill organizer of claim 1, wherein said hinged lid is transparent.

10. A pill organizer, comprising:

a housing having an upper surface having seven removable containers positioned vertically therein;

said removable containers extending above the upper surface;

seven recessed areas disposed on the housing;

each removable container and recessed areas corresponding to a day of a week;

wherein each of said recessed areas is adapted to receive one of said containers therein;

each of said removable containers having five compartments therein adapted to receive one or more pills;

said removable containers and compartments arranged in a calendar grid layout;

each of said compartments including a transparent hinged lid;

wherein said compartments include numerical indicia thereon corresponding to the numerical date of a calendar month, said compartments being numbered sequentially two the number thirty-one in said grid layout resembling the layout of a calendar month, such that a user can insert the one or more pills into the compartments in order to arrange them according to the particular numerical date of the calendar month in which they are scheduled to be taken;

a digital display disposed on said upper surface of said housing comprising a digital clock adapted to display the time of day and the numerical date of a calendar month corresponding to the indicia on one of said compartments for instructing a user to ingest the one or more pills inserted therein; and a notepad disposed on the upper surface of said housing.

* * * * *